United States Patent [19]

Nadkarni et al.

[11] 4,315,777

[45] Feb. 16, 1982

[54] METAL MASS ADAPTED FOR INTERNAL OXIDATION TO GENERATE DISPERSION STRENGTHENING

[75] Inventors: Anil V. Nadkarni, Mentor; Warren J. Haws, Berea; Charles I. Whitman, Bay Village, all of Ohio

[73] Assignee: SCM Corporation, New York, N.Y.

[21] Appl. No.: 64,371

[22] Filed: Aug. 7, 1979

[51] Int. Cl.[3] ..... B22F 3/00

[52] U.S. Cl. ..... 75/232; 75/235; 75/234; 75/206

[58] Field of Search ..... 75/234, 235, 232, 206

[56] References Cited

U.S. PATENT DOCUMENTS

| | | | |
|---|---|---|---|
| 3,026,200 | 3/1962 | Gregory et al. . | |
| 3,085,876 | 4/1963 | Alexander et al. | 75/232 X |
| 3,179,515 | 4/1965 | Grant et al. | 75/232 X |
| 3,184,835 | 5/1965 | Coxe et al. | 75/206 X |
| 3,311,464 | 3/1967 | Blomberg | 75/206 X |
| 3,399,086 | 8/1968 | Das et al. . | |
| 3,533,760 | 10/1970 | Weizenbach et al. | 75/206 X |
| 3,552,954 | 1/1971 | McDonald | 75/206 |
| 3,607,254 | 9/1971 | Hammond | 75/206 X |
| 3,615,899 | 10/1971 | Kimura . | |
| 3,765,216 | 10/1973 | Green . | |
| 3,779,714 | 12/1973 | Nadkarni et al. | 75/206 X |
| 3,821,036 | 6/1974 | Copeland et al. | 75/206 |
| 4,077,816 | 3/1978 | Nadkarni | 75/206 X |
| 4,156,053 | 5/1979 | Barunow et al. | 75/206 X |

*Primary Examiner*—Brooks H. Hunt

*Attorney, Agent, or Firm*—Robert A. Sturges; Merton H. Douthitt

[57] ABSTRACT

This invention relates to dispersion strengthening of metals. A coherent mass comprising an intimate blend of alloy powder and oxidant is formed prior to dispersion strengthening. Said coherent mass is easily formed because the alloy powder is not yet strengthened, and undergoes internal oxidation rapidly because of the intimate blend of alloy powder and oxidant.

9 Claims, No Drawings

METAL MASS ADAPTED FOR INTERNAL OXIDATION TO GENERATE DISPERSION STRENGTHENING

BACKGROUND OF THE INVENTION

The present invention relates to metal masses adapted for internal oxidation to generate dispersion strengthening by the in situ formation of hard, refractory oxide phases therein, and a process for dispersion strengthening which utilizes said metal masses.

In the past, it has been recognized that strength and hardness can be imparted to a solid solution alloy of ductile matrix metal, and a solute metal, the matrix metal having relatively low negative free energy of oxide formation, and the solute metal having a relatively high negative free energy of oxide formation. A substantial difference in negative free energy of oxide formation between matrix metal and solute metal is essential here. The negative free energy of oxide formation is a measure of the ease with which a metal will oxidize. A metal with a low negative free energy of oxide formation is difficult to oxidize, and a metal with a high negative free energy of oxide formation is easy to oxidize. By heating the alloy under oxidizing conditions, the solute metal preferentially oxidizes to cause the in situ formation of hard, refractory oxide particles in the matrix metal, substantially without oxidizing the matrix metal. This technique is known as the in situ internal oxidation of the solute metal to the solute metal oxide, or simply "internal oxidation". In internal oxidation, the matrix metal is relatively noble compared to the solute metal so that the solute metal will be preferentially oxidized.

The hard, refractory metal oxides formed in the matrix metal cause the alloy to be dispersion strengthened. Dispersion strengthening imparts to these materials a high strength, a high electrical conductivity and a high heat resistance. Dispersion strengthened metal products, such as copper dispersion strengthened with aluminum oxide, have many commercial and industrial uses where high temperature strength, high electrical conductivity, and/or heat conductivity are desired or required. Such uses include frictional brake parts such as linings, facings, drums, and the like and other machine parts for frictional applications, contact points for resistance welding electrodes, electrodes generally, electrical switches and electrical switch gear, transistor assemblies, wires for solderless connections, wires for electrical motors, lamp leads, and many other related applications. The metal masses of the present invention are useful in the production of dispersion strengthened products for the above and other applications.

In the past, attempts have been made to dispersion strengthen alloys by various methods of internal oxidation. These methods may be divided into two categories. The first category is powder metallurgical processes. The second category is internal oxidation of bulk alloy masses. In the first category, U.S. Pat. No. 3,026,200 shows the surface oxidation of alloy powder followed by a heat treatment in an inert atmosphere to diffuse oxygen from the surface of the alloy to preferentially oxidize the solute metal to solute metal oxide within the alloy powder.

U.S. Pat. No. 3,184,835 discloses the internal oxidation of copper-beryllium or copper-aluminum alloys wherein the oxidant is a sintered and milled mixture comprising about 50% copper oxide and about 50% aluminum oxide. The sintered oxidant residue is physically separated from the internally oxidized alloy powder before the powder is formed into dispersion strengthened metal products. The use of this sintered mixture as the oxidant is said to minimize adhesion of the oxidant residue to the internally oxidized alloy.

U.S. Pat. No. 3,779,714 discloses a process for the internal oxidation of alloy powders, for instance copper-aluminum alloy powders, wherein the oxidant is a blend of a heat-reducible metal oxide and a finely divided hard, refractory oxide. This oxidant blend is disposed such that after oxidation of the alloy powder is accomplished, the oxidant residue has substantially the same net composition as the internally oxidized alloy powder, and thus does not have to be removed.

In each of these cases, dispersion strengthened alloy powders are produced before any shapes or articles are attempted to be made from the powders. Such forming procedures after internal oxidation have proven to be very difficult because of the high strength of the dispersion strengthened alloy powders.

In the second category bulk alloy masses are internally oxidized. U.S. Pat. No. 3,399,086 discloses the internal oxidation of copper-aluminum alloy in plate or strip form using copper oxide as the oxidant. The shape to be oxidized is packed in the oxidant. The copper oxide is reduced to give up its oxygen for the preferential oxidation of the alloyed aluminum to form interspersed particles of aluminum oxide within the copper matrix. This process is disclosed as often taking several hours, and then, is usually only effective to dispersion strengthen a relatively thin section of the plate or strip surface.

U.S. Pat. No. 3,552,954 discloses a process for the internal oxidation of alloy strips. According to this process, the alloy strip is internally oxidized under a controlled atmosphere and then reduced in the presence of hydrogen to remove excess oxygen. The alloy strip is then pulverized and reformed into the final dispersion strengthened product. In this patent, it is disclosed that the original processed alloy strip was an unsuitable dispersion strengthened product because of excessive hydrogen embrittlement.

U.S. Pat. No. 3,615,899 discloses another method for the bulk internal oxidation of alloy parts. In this process, the alloy part is packed in a cuprous oxide oxidant which contains an inhibitor oxide. The oxidant blend is controlled to provide a maximum internal oxidation velocity. The maximum internal oxidation velocity is said to be required to produce optimum properties in the finished alloy part.

All of the prior art methods in this category dispersion strengthen a bulk alloy part by exposure to an oxidizing environment only at its surface which requires an extremely long period of time and/or the ultimate properties of the alloy are compromised by concomitant reactions which detract from ultimate performance.

One benefit of the present invention is that a cohesive mass of alloy powder and oxidant is formed and at least partial densification takes place before internally oxidizing to dispersion strengthen. Therefore, this forming requires less energy, less force, and produces less die wear than when forming is subsequent to dispersion strengthening.

Another benefit of the present invention is that it produces more intimate contact between the alloy to be internally oxidized and the oxidant. This improved contact decreases internal oxidation time and improves oxygen transfer from oxidant to solute metal in the alloy.

A further benefit derived from the present invention is that a preformed shape can be dispersion strengthened uniformly throughout and in a fraction of the length of time previously required for dispersion strengthening of preformed shapes.

SUMMARY OF THE INVENTION

The present invention is a preformed charge stock for making a mass of dispersion strengthened metal by internal oxidation and a process for making a dispersion strengthened metal mass utilizing said charge stock. The preformed charge stock is a coherent mass made of an intimate interspersion of alloy particles and oxidant. The alloy contains matrix metal and solute metal. The matrix metal has a low negative free energy of oxide formation, and the solute metal has a high negative free energy of oxide formation, such that there is a substantial difference between the negative free energies of oxide formation of matrix metal and solute metal. The oxidant is a heat-reducible metal oxide having a predetermined negative free energy of oxide formation such that it can oxidize solute metal, but not matrix metal. The amount of oxidant present is adequate for oxidizing, under internal oxidation conditions, sufficient of the solute metal to impart dispersion strengthening of the matrix.

The present process for making a dispersion strengthened metal mass utilizes the above preformed charge stock. The preformed charge stock is first made by forming a coherent mass of alloy powder and oxidant. The preformed charge stock is then internally oxidized by heating until the solute metal portion of the alloy powder is sufficiently converted into hard, refractory oxide particles to impart dispersion strengthening of the matrix metal. Optionally, the dispersion strengthened product is then further shaped and/or densified.

DETAILED DESCRIPTION OF THE INVENTION

In achieving the objects of the present invention, one feature provides for the formation of a coherent mass of intimately blended alloy powder and oxidant.

It has been discovered that making a preformed charge stock of alloy powder and oxidant is substantially easier than forming fully dispersion strengthened alloy powder, even if their net compositions are approximately the same. For example, it takes less force to form a blend of alloy powder and oxidant into a cohesive mass of a given percentage of theoretical density than to form dispersion strengthened metal of the same net composition into the same shape of the same density. This reduced force will also result in reduced wear of the forming dies and a reduction in lamination during forming. Laminations are cracks which form early in a forming process and tend to close later, but remain as weak sites in the finished product. The coherent mass so formed has further been found to be stronger and more ductile than preforms made of dispersion strengthened metals. This property will be found to be particularly beneficial if the coherent mass is subsequently rolled, forged or swaged.

The alloy powder is an alloy of matrix metal and solute metal. The alloy powder can be spheroidal, flake or irregularly shaped. It is intimately blended with oxidant in a preformed charge stock adapted for the internal oxidation of solute metal to solute metal oxide. Said matrix metal has a negative free energy of oxide formation per gram atom of oxygen at 25° C. ranging from 0 to 70 kilocalories. The netative free energy of oxide formation of the solute metal oxide exceeds the negative free energy of oxide formation of the matrix metal oxide by at least 60 kilocalories per gram atom of oxygen at 25° C. The intimately admixed oxidant comprises a pulverulent, in situ, heat-reducible metal oxide having a negative free energy of oxide formation at 25° C. less than that of the solute metal, such that it can oxidize solute metal. Optionally, the oxidant can contain an interspersion of discrete particles of hard, refractory oxide. In such case, the negative free energy of oxide formation of said hard, refractory oxide exceeds the negative free energy of oxide formation of said heat-reducible metal oxide, usually by at least about 60 kilocalories per gram atom of oxygen at 25° C. Preferably, the hard, refractory oxide is present in a proportion and particle size adapted for dispersion strengthening of the oxidant residue resulting from internal oxidation.

The heat-reducible metal oxide can contain the same or different metal moiety from the matrix metal of the alloy. Similarly, the hard, refractory oxide can be the same or different metal oxide than results from the internal oxidation of the solute metal to solute metal oxide in the alloy.

The pulverulent, in situ, heat-reducible metal oxide in the oxidant is preferably in substantial stoichiometric proportion for internal oxidation of all the solute metal to solute metal oxide in the alloy. This proportion can, however, broadly vary as much as ±50% or more. Such variation can be required under some circumstances to be effective. After internal oxidation, the oxidant residue comprises uniformly distributed agglomerates consisting of in situ reduced metal and optional particles of hard, refractory oxide. These agglomerates are in intimate mixture with the particles of internally oxidized alloy in the coherent mass.

Suitable matrix metals for practicing this invention include the following: iron, cobalt, nickel, copper, thallium, germanium, tin, lead, antimony, bismuth, molybdenum, tungsten, rhenium, indium, silver, gold, ruthenium, palladium, osmium, platinum, and rhodium. Mixtures of suitable matrix metals and alloys thereof can also be used.

Suitable solute metals for practicing this invention include: silicon, titanium, zirconium, aluminum, beryllium, thorium, chromium, magnesium, manganese, niobium, tantalum, and vanadium.

Suitable heat-reducible metal oxides for use as the oxidant for practicing this invention include: FeO, $Fe_2O_3$, CoO, NiO, $Cu_2O$, CuO, $Tl_2O$, $GeO_2$, SnO, $SnO_2$, PbO, $Sb_2O_3$, $Bi_2O_3$, $MoO_3$, $MoO_2$, $WO_2$, $WO_3$, $ReO_3$, $In_2O_3$, $Ag_2O$, $Au_2O$, $RuO_2$, PdO, $OsO_4$, PtO, and $Rh_2O_3$.

Suitable hard, refractory oxides for use in practicing this invention include the following: $SiO_2$, $TiO_2$, $ZrO_2$, $Al_2O_3$, BeO, $ThO_2$, $Cr_2O_3$, MgO, MnO, $Nb_2O_5$, $Ta_2O_5$, and VO.

Suitable matrix metal/solute metal/oxidant combinations useful in practicing this invention include: Cu/Al/$Cu_2O$, Ni/Al/NiO, Ni/Be/NiO, Ni/Zr/NiO, Fe/Al/FeO-$Fe_2O_3$, Ag/Al/$Ag_2O$, Cu-Ni/Al/NiO, and Ag/Mg/$Ag_2O$.

Preferably, the in situ heat-reducible metal oxide in the oxidant contains the same metal moiety as the matrix metal in the alloy powder. Preferably also, the optional hard, refractory oxide in the oxidant contains the same metal moiety as the solute metal in the alloy powder. In one particularly commercially important embodiment of this preferred practice, the oxidant contains substantially the same proportions of matrix metal moiety and solute metal moiety as are present in the alloy powder. Thus, upon internal oxidation of the preformed charge stock, the oxidant residue itself is of substantially the same composition as the internally oxidized alloy and becomes dispersion strengthened herewith.

Another feature of the present invention resides in a preformed charge stock composition based upon an alloy of matrix metal and about 0.01 to about 5% by weight solute metal adapted for further coalescence upon hot working to form dispersion strengthened metal articles. To achieve the proper proportion of oxidant, said composition further comprises about 0.1 to about 10 parts by weight of oxidant per 100 parts of alloy. The exact proportions depend on the solute metal to be oxidized, its concentration in the alloy and the oxygen content of the oxidant.

The preformed charge stock can further comprise a small proportion of a fugitive binder without departing from the essence of this invention. Said binder must be carefully selected such that no residue is left after the internal oxidation step. Such residue would be detrimental to the ultimate properties of the finished workpiece. Suitable binders are ammonium alginate, starch, starch glyceride, polyvinyl alcohols, Carbowax, furfuryl alcohol resins, polyvinyl acetate, oils and other liquids.

According to the process of the present invention, the oxidant is intimately admixed with alloy particles. The mixture is formed into a charge stock and the charge stock is subjected to internal oxidation conditions. After the preformed charge stock is internally oxidized, the oxidant residue remains as a portion of the final product. The oxidant residue is present, however, in such small proportions that it does not significantly adversely affect the properties of the finished product. Optionally, this oxidant residue additionally contains fine particles of a hard, refractory oxide, which can serve to dispersion strengthen the oxidant residue to form an integral part of the resulting workpiece.

Mixing of alloy particles and oxidant can be carried out in any convenient and effective manner. Obtaining an intimate, homogeneous admixture, however, is very important, because it is theorized that the oxygen atmosphere within the coherent mass cannot equalize as readily as it can when the powder is loosely filled in a tray or other container. Ball milling or other such grinding techniques has been found to be particularly advantageous for this mixing operation (e.g. Hardinge conical ball milling, dry pan muller mixing, and enclosed cage milling using variously shaped grinding media, such as cylinders, pyramids, cones and double cones). It not only provides an intimate homogeneous admixture, but also is believed to break up surface oxides on the alloy powder, causes some oxidant to be driven into the alloy powder particle surface, and flattens some of the alloy powder particles. Regardless of theory, ball milling or other such conventional grinding techniques used for mixing of alloy powder and oxidant has been shown to increase the rate at which sintering occurs and has been shown advantageous in attempts to lower the temperature and time required for internal oxidation. Parts formed from such powder exhibit improved interparticle bonding and more uniform dispersion strengthening.

The intimate blend of oxidant and alloy powder is then formed into a charge stock. This formation process may be any conventional forging, rolling, extruding, swaging, or pressing process or otherwise. The preformed charge stock may be only partially dense, for example, 60% of theoretical density, on up to fully dense (100% of theoretical density) with no voids. This is a greater degree of flexibility in forming techniques than is possible for regular dispersion strengthened metal powders. If, for example, dispersion strengthened metal powder made pursuant to prior art instructions is pressed directly to 90% of theoretical density, it tends to laminate (crack) and give rise to weak spots after subsequent sintering. However, a preformed charge stock of the present invention formed by pressing directly to 90% theoretical density does not develop cracks or weak spots during sintering.

This step of the process can be performed continuously or stepwise. It has been found advantageous for the formation of certain extrudable shapes to use a continuous powder extruding process. Such a process will continuously compress powder and expel an extruded strand of alloy power and oxidant blend. An apparatus for one such process is disclosed in U.S. Pat. No. 3,765,216 the disclosure of which is hereby incorporated herein by reference. This apparatus is particularly adapted to extruding metal powders, and is termed a "Conform machine". Its use is described as a metal extrusion process in which the force for extrusion of the metal through a die is derived, at least in part, by maintaining frictional engagement of the metal with passageway defining surfaces of a member which is moved towards the die such that frictional drag of the passageway defining surfaces urges the metal through the die. The use of this machine allows the production of a continuous wire or rod-shaped part by continuous feeding of alloy-powder/oxidant blend. The length of the part formed is not limited by the size of the original charge that can be placed in the machine.

The internal oxidation operation is preferably carried out at a temperature in the range of 1400° F. to 1700° F. Lower temperatures can be used such as about 1200° F. or below with very little sacrifice in properties or efficiency particularly when the preformed charge stock is formed from a blend of alloy powder and oxidant which is rendered particularly intimate by use of a ball mill or the like. Higher temperatures also can be used with some reduction in time required for the complete formation of the oxide, but close temperature control is then necessary to avoid local overheating which might result in partial or incipient fusion of the metal. This step of the process can also be performed stepwise or on a continuous basis.

Annealing to increase grain size can be practiced before or in combination with the internal oxidation operation. Solute metal oxide tends to concentrate at grain boundaries in the alloy powder. This is undesirable because it can cause early failure under stress at these grain boundaries. It is, therefore, often desirable to reduce the grain boundary area in the alloy powder and this is accomplished by annealing the powder to form a larger grain size. The annealing operation can be performed on the alloy powder before formation of the preformed charge stock, or it can be practiced on the preformed charge stock before or in conjunction with the internal oxidation operation. When alloy powder is to be annealed to increase grain size, this step should be subsequent to all milling operations on the powder, because milling will tend to reduce the grain size. For copper-aluminum alloys, which are one of the more commercially important embodiments of the present invention, annealing temperatures of about 1600° F. for one hour in an inert atmopshere such as argon, produce an acceptable grain size of at least about ASTM grain size No. 6 by ASTM Test E-112. If annealing is practiced in combination with internal oxidation, the annealing temperature and atmosphere should be controlled so that the grain size will increase to the desired dimensions before internal oxidation takes place.

The time required for the internal oxidation of the preformed charge stock is similar to the time required for internal oxidation of powders rather than the previously reported time required for internal oxidation of bulk alloy parts. This is because the oxidant is intimately interspersed throughout the charge stock such that oxygen released from the oxidant has only a very short distance to travel to effect internal oxidation of the alloy particles regardless of the outside dimensions of the charge stock.

Further, it has been found there is more intimate contact between the oxidant and alloy particles within the charge stock than there is in a mere loose physical blend of oxidant and alloy particles. This increased contact in some cases will actually allow internal oxidation to proceed at a faster rate for the charge stock than it will for loose powders, particularly if the alloy powder and oxidant were milled together rather than just blended.

Alloy powders suitable for use in the process of the present invention typically have a maximum dimension of about 280 microns and preferably have a maximum dimension of about 140 microns. The ratio of the average largest dimension of the alloy particles to the largest dimension of the oxidant particles should be at least about 2:1 and usually is between about 5:1 and about 30:1 or even higher if practical. This is to provide desirable interparticle contacts for efficient reaction and to maximize homogeneity of the final product. Generally, the oxidant particles are micron or sub-micron in particle size.

There are several methods for incorporating the optional refractory oxide particles in the oxidant of the present invention. In one method, an oxide forming salt of the refractory is applied to and decomposed on a particle of a heat-reducible metal oxide having a particle size in the micron or sub-micron range. In the case of the copper-aluminum system, for instance, sub-micron cuprous/cupric oxide particles are treated with an aqueous solution of aluminum nitrate so as to form a uniform coating. The particles are dried and heated to decompose the aluminum nitrate and form cuprous/cupric oxide particles having a uniform coating of aluminum oxide thereon. The amount of aluminum nitrate added is predetermined according to the aluminum oxide content desired in the final product. In another method, micron or sub-micron particles of heat-reducible metal oxide and refractory oxide particles are intimately blended in a blending device to provide the oxidant.

Internal oxidation of a preformed charge stock composed of the previously described materials can be advantageously accomplished in about 30 minutes to 1 hour. Shorter periods of time are possible where the alloy particles and oxidant particles are smaller or the oxidation temperature is increased. Similarly, the oxidation time can be longer if the particles are larger in size or the oxidation temperature is reduced. In either case, it is important to note that the oxidation time is correlated to the distance the oxygen must travel and not to the size of the charge stock. In the charge stock oxygen must only travel only about the same distance as oxygen must travel in a loose oxidant and alloy powder mixture.

Strength and density of the internally oxidized dispersion strengthened product can be further increased by hot or cold working the dispersion strengthened product. The increase in strength thus obtained is substantially retained even when the worked dispersion hardened product is heated above the annealing temperature of the matrix alloy. Also, if the oxidant contains the optional refractory oxide component, the further working of the internally oxidized dispersion strengthened product can serve to dispersion strengthen the oxidant residue.

The following examples show ways that we have operated this invention. The examples should not be construed as limiting the invention. All temperatures are given in degrees Fahrenheit and all percentages are weight percentages, unless otherwise specified.

EXAMPLE 1

Oxidant was prepared by blending 98.6 parts of commercially available cuprous oxide ($Cu_2O$) with 1.4 parts of $Al_2O_3$ of about 0.01–0.02$\mu$ particle size. Blending was accomplished by rolling the powders in a glass jar with three 1" porcelain mill balls.

Sixty (60) g of oxidant and 1,000 g of atomized alloy powder were then ball milled together for 8 hours in a steel-lined ball mill using steel balls. The alloy powder contained 99.4% Cu and 0.6% Al and would substantially pass through a 60 mesh screen and be retained on a 325 mesh screen (Tyler Standard Sieves). Copper (Cu) can oxidize to form CuO and/or $Cu_2O$. Aluminum (Al) can oxidize to form $Al_2O_3$. Similarly CuO and $Cu_2O$ can be reduced to form Cu and $Al_2O_3$ can be reduced to form Al. The negative free energies of oxide formation at 25° C. for CuO, $Cu_2O$, and $Al_2O_3$ are 32, 35, and 126 kilocalories per gram atom of oxygen, respectively. The oxidant level represents 90% of the amount of oxidant calculated to be required to fully oxidize the aluminum present in the alloy. Note also that ball milling in air will tend to oxidize some of the copper to copper oxides and thus make up at least part of the oxidant deficiency.

Fifteen (15) grams of the oxidant/alloy blend was placed in a die measuring about $\frac{1}{2}'' \times 1\text{-}\frac{1}{8}''$ and pressed at 32,000 lbs./sq. in. using a hydraulic press. This pressure was predetermined to yield a part having 80% of theoretical density. Six samples were so produced.

The samples were heated for various times and temperatures as shown in Table 1. This caused concomitant sintering and internal oxidation. Transverse rupture strength was then determined in accordance with ASTM test B 528-70 (Transverse Rupture Strength of Sintered Metal Powder Specimens), the disclosure of which is expressly incorporated herein by reference. This data is shown in Table 1.

This test is designed to generate data and calculate "transverse rupture strength". It defines the stress, calculated from the flexure formula, required to break a specimen as a simple beam supported near the ends and applying the load midway between the fixed center line of the supports.

Transverse rupture strength is calculated as follows:

$$TRS=(3XPXL)/(2Xt^2XW)$$

where:

TRS=transverse rupture strength of the sintered compact, in psi,

P=load, lbf, required to rupture the specimen,

L=length of specimen span of fixture, in. (1.00 in.),

W=width of the specimen, in., and t=thickness of specimen, in.

EXAMPLE 2

Commercially available dispersion strengthened alloy power with the same net composition as the samples produced in Example 1 was obtained. This powder is designated AL-60 and is available from Glidden Metals, 1468 West 9th Street, Cleveland, Ohio 44113. It was prepared in accordance with U.S. Pat. No. 3,779,714, the disclosure of which is expressly incorporated herein by reference.

Six (6) parts were made by pressing at 49,000 psi and sintering as described in Example 1. Transverse rupture strength was determined and the data is shown in Table 1.

EXAMPLE 3

In the procedure of Example 1, six parts were produced by pressing at 75,000 lbs./sq. in. This pressure was predetermined to yield a part of about 90% of theoretical density. Transverse rupture strength data is shown in Table 1.

EXAMPLE 4

In the procedure of Example 2, six parts were produced by pressing at 97,000 lbs./sq. in. These parts formed laminates (cracks) during sintering that prevented accurate transverse rupture strength determinations.

TABLE 1

TRANSVERSE RUPTURE STRENGTH DATA

| Sintering Time | Sintering Temperature, °F. | Parts of Example 1 | Parts of Example 2 | Parts of Example 3 |
|---|---|---|---|---|
| 1 hour | 1600 | 10600 | — | 26900 |
| | 1750 | — | 10200 | — |
| | 1800 | 16400 | — | 37800 |
| | 1850 | — | 11500 | — |

TABLE 1-continued

TRANSVERSE RUPTURE STRENGTH DATA

| Sintering Time | Sintering Temperature, °F. | Parts of Example 1 | Parts of Example 2 | Parts of Example 3 |
|---|---|---|---|---|
| | 1900 | — | — | — |
| | 1950 | 22200 | 14200 | 39300 |
| 7 hours | 1600 | 12200 | — | 28300 |
| | 1750 | — | 11300 | — |
| | 1800 | 17200 | — | 39300 |
| | 1850 | — | 15700 | — |
| | 1900 | — | — | — |
| | 1950 | 26600 | 18200 | 63900 |

What is claimed is:

1. A process for dispersion strengthening metal by internal oxidation, comprising:

forming a substantially uniform coherent mass of alloy and oxidant, wherein said alloy comprises a matrix metal having a negative free energy of oxide formation at 25° C. of 0 to 70 kilocalories per gram atom of oxygen and a solute metal having a negative free energy of oxide formation exceeding that of said matrix metal by at least about 60 kilocalories per gram atom of oxygen at 25° C., and said oxidant being a heat-reducible metal oxide having a negative free energy of oxide formation at 25° C. less than the negative free energy of oxide formation of the solute metal for oxidizing the solute metal to a solute metal oxide; and oxidizing said solute metal under internal oxidation conditions to dispersion strengthen said coherent mass.

2. The process in claim 1 wherein said coherent mass contains a refractory oxide.

3. The process in claim 1 wherein said alloy is annealed prior to the step of forming a coherent mass to increase the grain size of said alloy.

4. The process in claim 1 wherein the internally oxidized coherent mass is further densified after the step of internal oxidation.

5. The process is claim 1 wherein the coherent mass is in the form of a wire, foil, block, or extrudate strand.

6. The process in claim 1 wherein the coherent mass is a preformed specially shaped part.

7. The process in claim 1 wherein the alloy matrix metal is copper and the solute metal is aluminum.

8. The process in claim 7 wherein the oxidant is cuprous oxide.

9. The dispersion strengthened metal product produced by the process of claim 1.

* * * * *